US005963083A

United States Patent [19]

Kothandaraman et al.

[11] Patent Number: 5,963,083

[45] Date of Patent: Oct. 5, 1999

[54] CMOS REFERENCE VOLTAGE GENERATOR

[75] Inventors: Makeshwar Kothandaraman; Bernard Lee Morris, both of Emmaus; Bijit Thakorbhai Patel, Breinigsville; Wayne E. Werner, Coopersburg, all of Pa.

[73] Assignee: Lucent Technologies, Inc., Murray Hill, N.J.

[21] Appl. No.: 09/067,818

[22] Filed: Apr. 28, 1998

[51] Int. Cl.[6] ..... G05F 1/10

[52] U.S. Cl. ..... 327/545; 327/530; 365/229

[58] Field of Search ..... 327/309, 530, 327/540, 541, 543, 545; 365/226, 229, 189.09

[56] References Cited

U.S. PATENT DOCUMENTS 5,532,676 7/1996 Moore, III ..... 327/545

5,592,121 1/1997 Jung et al. ..... 327/541

5,694,075 12/1997 Bingham ..... 327/545

5,898,618 4/1999 Bakkapragada et al. ..... 327/530

*Primary Examiner*—Jung Ho Kim

[57] ABSTRACT

A CMOS voltage generator for providing a reference voltage VDD2 that will track the low level power supply voltage VDD (approximately 3.0V–3.6V) as long as the power supply is present. When VDD is not present (defined as at "hot pluggable" condition), the voltage generator is configured to maintain a "protection" output voltage less than the relatively high voltage (approximately 5V) that may appear along a circuit signal bus. In particular, the circuit includes at least a pair of diode-connected N-channel devices disposed between the signal bus line and the output voltage terminal to provide the necessary protection.

6 Claims, 3 Drawing Sheets

CM OS REFERENCE VOLTAGE GENERATOR

BACKGROUND OF THE INVENTION

1. Technical Field

The present invention relates to a CMOS reference voltage generator and, more particularly, to a voltage generator for providing a reference voltage protected from changes in VDD, as well as from high voltages that may appear on signal bus lines.

2. Description of the Prior Art

In many areas of CMOS circuit design there are arrangements that include sections that run between 0–5V and other sections that use a voltage supply range of only 0–3.3V. There is often a need to provide a "buffer" circuit between these sections. Thus, there is a need to supply a circuit implemented in standard low voltage CMOS technology (e.g., 3.3V nominal) that can tolerate a relative high voltage (i.e., 5V) on its input. Additionally, many system configurations require a circuit that is "hot pluggable", meaning that the circuit will not draw any current from a bus that is at a high voltage, even when the circuit is not powered (i.e., when VDD is not present). Further, the circuit should be designed so that it is not "harmed" when exposed to relatively high voltages. In particular, if the gate oxide of a MOS transistor is subjected to too high a voltage, it will break down, causing gate-to-drain and/or gate-to-source shorts. Likewise, the drain-to-source junction of a MOS transistor will be degraded by hot carriers if it is subjected to too great a voltage. Thus, a MOS circuit that is subjected to voltages higher than the technology is designed to work at must be designed in such a way that the individual transistors in the circuit never see these higher voltages across their gate oxides or their source-to-drain junctions.

One problem with a low voltage technology CMOS buffer interfacing with a relatively high voltage is that the source of a P-channel output transistor is usually connected to the low voltage power supply VDD. If a voltage greater than VDD is applied to the drain of this device (where the drain is usually connected to the PAD of the buffer), it will forward bias the parasitic diode inherent in the P-channel device, since the N-tub backgate of the P-channel transistors is usually connected to VDD.

The prior art circuit of FIG. 1 solves this problem by generating a supply voltage VFLT that is equal to VDD when the PAD voltage is less than VDD, and that is equal to the PAD voltage when PAD is greater than VDD. This reference voltage VFLT is then applied to the N-tub backgate of all P-channel transistors whose source or drain is connected to PAD voltage. The use of VFLT prevents the parasitic diodes of these transistors from ever being forward biased. Referring to FIG. 1, voltage generator circuit 10 is configured to generate a supply voltage VFLT that may be applied to the N-tub backgate of a pair of P-channel transistors 12 and 14. As configured, circuit 10 is used for situations where the PAD voltage (signal bus) appearing at node A may be (at times) greater than the supply voltage VDD. In particular, when PAD goes higher than VDD by a single P-channel threshold voltage, denoted Vtp, transistor 14 turns "on" and transistor 12 turns "off". The output voltage, VFLT, is then equal to the PAD voltage. During normal operating conditions when PAD<VDD, transistor 12 will be "on" and transistor 14 will be "off", allowing output voltage VFLT to be equal to VDD. Therefore, the backgate voltage will be brought to the high level of PAD and prevent the turn on of its associated parasitic diode. While this design affords some protection for high voltages appearing at the PAD terminal, it is not "hot pluggable". That is, if VDD is not present, circuit 10 as depicted in FIG. 1 will have the full PAD voltage across the gate oxide of transistor 12. If this PAD is a relatively high voltage, then the reliability of the circuit is at risk.

One known solution to the above criteria is to utilize a relatively thick gate oxide for any devices that may be exposed to the relatively high voltages at their gate terminals and utilize a standard gate oxide for all remaining devices. This is a very expensive technique that adds appreciable extra cost and process time to conventional CMOS circuit processing.

SUMMARY OF THE INVENTION

The present invention relates to a CMOS reference voltage generator and, more particularly, to a voltage generator that addresses the above problems by generating a voltage VDD2 that is used in place of VDD in the circuit of FIG. 1. The use of this reference voltage solves the reliability problem that occurs in the circuit of FIG. 1 when VDD is not present and a relatively high voltage is applied to PAD.

The CMOS circuit is configured such that a generated reference voltage VDD2 is essentially equal to the power supply VDD as long as VDD is "present" (typically 3.0–3.6 volts, but in general any voltage above approximately 1 V), regardless of the voltage on the signal bus ("PAD"), which may rise to, for example, 5V if a mix of CMOS technology is present in the circuit. If VDD is not present—meaning either that VDD=0, or any other condition where the VDD voltage does not register, such as a broken lead or disconnection (all of these situations hereinafter referred to as a "hot pluggable" condition), the circuit is configured to maintain VDD2 at a level of at least two diode drops below the voltage appearing at PAD. Therefore, even in the situation where PAD=5.5V, VDD2 will be approximately 2.8V and will therefore protect any and all following circuit elements from the PAD high voltage.

In one embodiment, an exemplary CMOS circuit of the present invention comprises a first P-channel device coupled at its source to VDD and a first N-channel device having its gate coupled to VDD, where the drain of the N-channel device is used as the gate input to the P-channel device and the source of the N-channel device is coupled to VSS. A pair of N-channel devices are diode-connected (i.e., the gate and source terminals are coupled together) and disposed in series between the drain of the P-channel device and the signal bus rail ("PAD"). A second P-channel device is coupled between the gate and drain of the first P-channel device, with the gate of the second P-channel device held at VDD. A third P-channel device is coupled between the diode-coupled N-channel devices and VSS, with the gate of the third device also held at VDD. The output voltage, VDD2, is taken from the drain terminal of the third P-channel device.

In operation, as long as VDD is present, the N-channel device will be "on", pulling the gate of the first P-channel device to VSS and thereby allowing the full voltage of VDD at the source of the first P-channel device to appear at its drain (output node VDD2). If VDD is not present ("hot pluggable") and (in a worst case condition) PAD=5.5V, the N-channel and first P-channel devices will be "off", and the diode-connected devices will each provide an associated voltage drop (Vd) between the PAD node and the output. For the embodiment where a pair of diode-connected devices are used (providing a 2 Vd voltage drop) and PAD=5.5V, the output voltage VDD2 will be approximately 2.8V. It is to be understood that additional diode-connected devices may be included.

In an alternative embodiment of the present invention a second reference voltage VD2P may be generated by coupling a diode-connected P-channel device at output VDD2, where this second output reference voltage will be approximately one P-channel threshold voltage (Vtp) below VDD2. Alternatively, an N-channel device may be coupled to VDD2 and a reference voltage VD2N may be formed that is approximately one N-channel threshold below VDD2.

Various features and elements of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
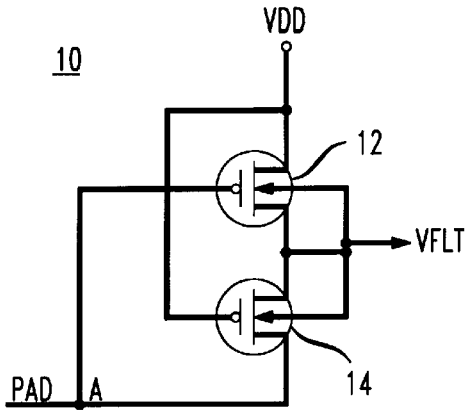
FIG. 1 PRIOR ART
FIG. 1 illustrates a prior art CMOS reference voltage generator as discussed above.
Figure 2:
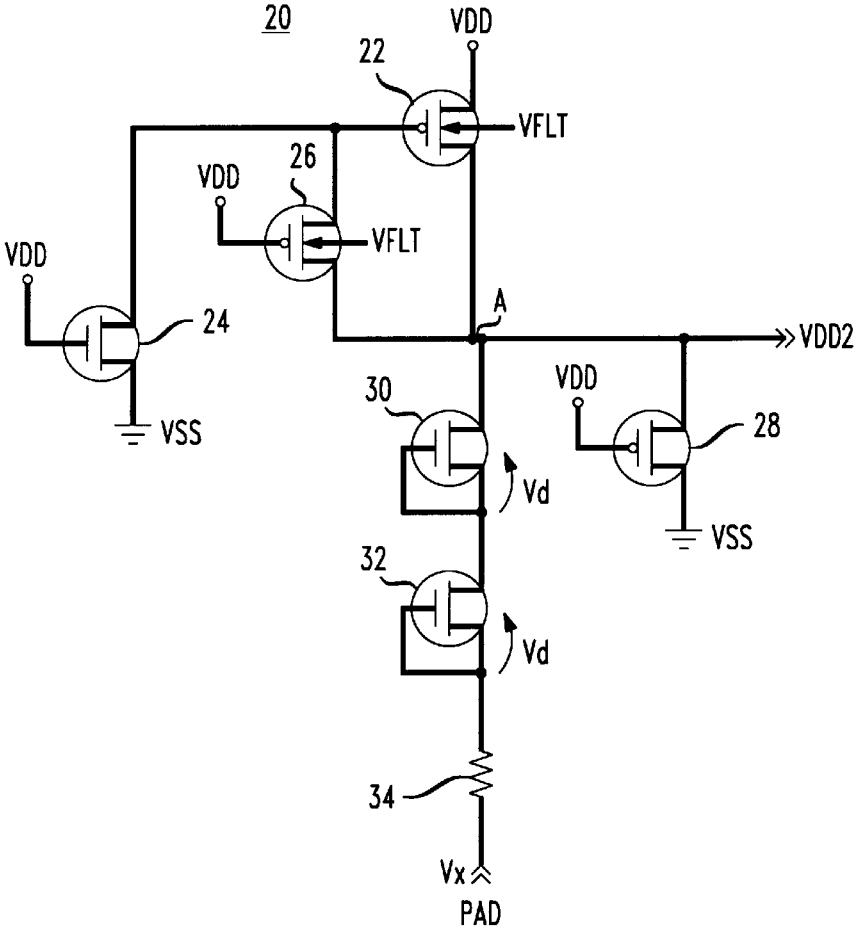
FIG. 2 contains a schematic diagram of an exemplary CMOS reference voltage generator circuit formed in accordance with the present invention.

A schematic diagram of an exemplary CMOS voltage generator 20 of the present invention is illustrated in FIG. 2. Generator receives as inputs the power supply voltages VDD and VSS, VDD being the positive supply voltage (i.e., 3.0–3.6V range, nominally 3.3V for low voltage CMOS circuitry) and VSS being "ground". The remaining input voltage is labeled "PAD" in FIG. 2 and represents the voltage present along a CMOS circuit signal line. In many cases the PAD voltage may be as high as 5V. As mentioned above, many system configurations require buffer circuits that are "hot pluggable", meaning that the buffer will not draw any current from a bus (such as the signal line) that is at a high voltage, even when VDD is not present. CMOS voltage generator 20 is a useful circuit for providing a reference voltage VDD2 that will remain less than or equal to VDD, regardless of the PAD voltage and regardless of the state of VDD. Various other buffer circuit arrangements that all utilize this VDD2 to enable the formation of "hot-pluggable" buffer circuits may advantageously use the voltage generator of the present invention.

Referring to FIG. 2, generator circuit 20 comprises a first P-channel MOS transistor 22 with its source coupled to supply voltage VDD and its drain coupled to output terminal VDD2 at node A. A first N-channel MOS device 24 has its gate biased at VDD, its drain coupled to the gate of P-channel device 22 and its source coupled to power supply VSS. As long as VDD is "on", N-channel device 24 will be "on", pulling the gate terminal of P-channel device 22 to the VSS potential and subsequently turning "on" device 22. Device 22 is formed as a relatively large device, thus exhibiting a relatively low resistance path between its source (VDD) and drain (VDD2) so that output voltage VDD2 will be essentially equal to VDD. Therefore, as long as VDD is "on", VDD2=VDD, regardless of the voltage appearing at the PAD terminal.

Voltage generator 20 includes additional components that are used to safeguard the value of VDD2 during "hot plug" conditions, that is, the circuit is configured to keep VDD2 from rising above a nominal 3.6V and drawing a current when VDD is not present. Referring to FIG. 2, generator circuit 20 further comprises a second P-channel device 26 coupled between the gate and source terminals of first P-channel device 22. The gate terminal of P-channel device 26 is held at VDD. A third P-channel device 28 is coupled at its drain to node A (VDD2) and at its source to power supply VSS. The gate terminal of third P-channel device 28 is also held at VDD. Therefore, as long as VDD is "on", devices 26 and 28 will remain "off" and not affect the operation of generator circuit 20. During a "hot plug" condition, VDD will be equal to 0 (that is, no power is supplied to the circuit). In this case, devices 26 and 28 will turn "on" and devices 22 and 24 will both be "off". The turning "off" of device 22 creates a high resistance path between its source and drain, removing potential VDD as the source for output voltage VDD2. The path to output voltage VDD2 is now changed from P-channel device 22 to a pair of diode-connected N-channel devices 30 and 32 which are connected in series between output node A and a "PAD" terminal, where the PAD terminal may represent a relatively high (5V, for example) signal bus present on the integrated circuit. Therefore, for any condition where there is voltage present at the "PAD" terminal during this "hot plug" condition, a diode voltage drop Vd will appear across each device 30 and 32, thereby reduce the PAD voltage by a value of 2 Vd at node A. A small (approximately 200 ohm) resistor 34 which protects against ESD voltages is also included in series with devices 30 and 32. Thus, even when a high voltage is present at the PAD during a "hot plug" event, diode-connected devices 30 and 32 will maintain VDD2 at least two diode-drops below PAD, safeguarding any following circuitry from experiencing the full PAD voltage level. Device 28, which has a relatively high resistance, is needed to supply a DC path from the PAD to VSS, so that the diode drop Vd is well-controlled.

In summary, the generator circuit 20 of FIG. 2 functions to provide an output voltage VDD2 essentially equal to the "low voltage" power supply VDD (that is, within the range 3.0–3.6 volts) as long as the power supply is present. During conditions when VDD is not present ("hot plug" condition), the circuit protects output voltage VDD2 from approaching the "high voltage" (i.e., 5 volts) that may be present along a signal bus by incorporating a pair of diode-connected devices between the signal bus (PAD) and output terminal VDD2.

Figure 3:
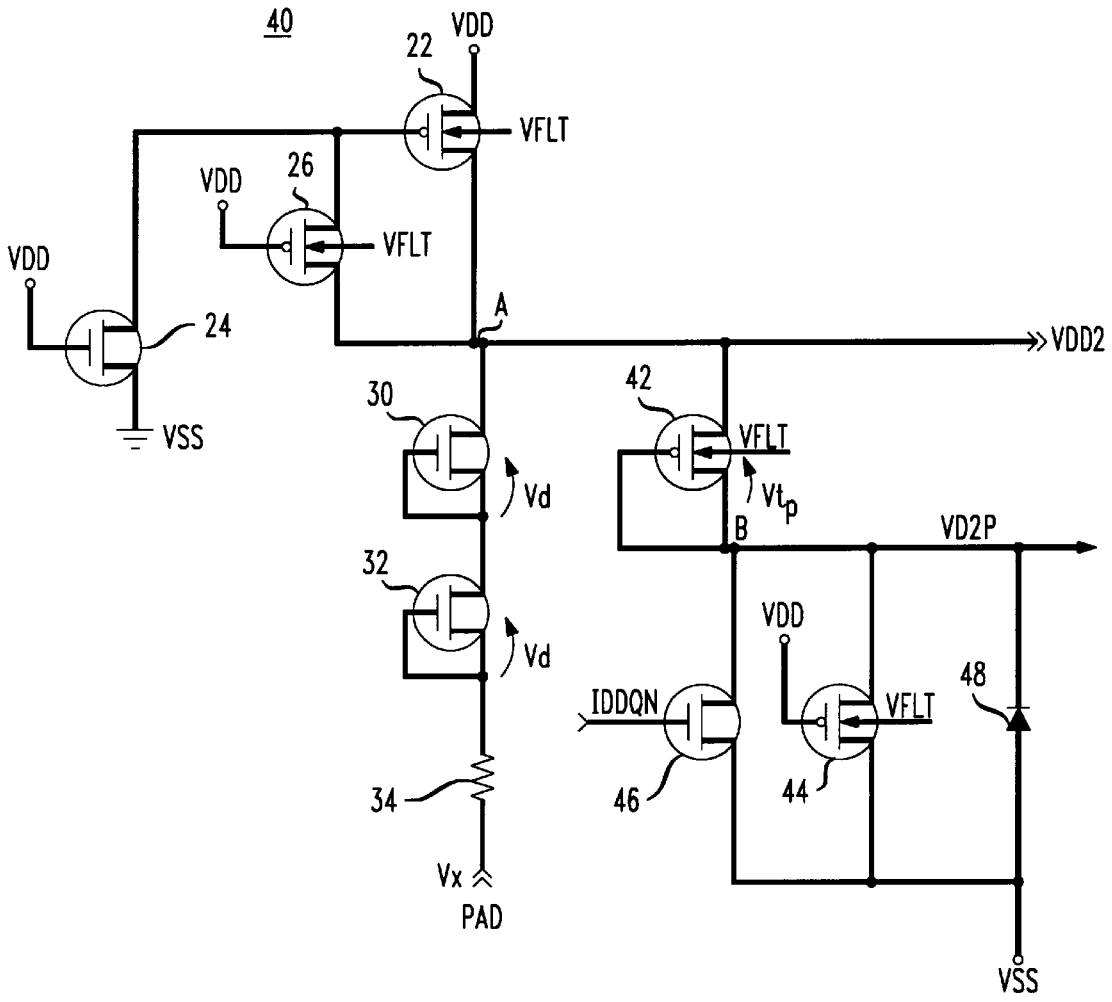
FIG. 3 illustrates an alternative circuit design for a CMOS reference voltage generator of the present invention.

An alternative arrangement of a CMOS voltage generator circuit is illustrated in FIG. 3. Circuit generator 40, as shown, contains many devices similar to those discussed above in association with generator 20 of FIG. 2. In particular, devices 22, 24, 26, 30, 32 and 34 all function as described above in association with the arrangement of generator 20 and thus provide a reference output voltage VDD2 in the same manner. Generator 40 is configured to comprise additional components to generate a second output voltage that is related to first output voltage VDD2. Referring to FIG. 3, generator 40 further comprises a P-channel MOS device 42 that is diode-connected and coupled at its source terminal to node A, that is, to first output voltage VDD2. A second P-channel device 44 is coupled at a first terminal to the diode connection of device 42, this coupling being defined as node B in FIG. 3. The gate terminal of second device 44 is held at VDD. An N-channel device 46 is coupled across the source and drain terminals of device 44, where a relatively low (microamp value) current is applied through device 46 to establish a current path for the illustrated arrangement. A diode 48 is also coupled across device 44.

When VDD is present, transistor 44 will be "off" and the output voltage present at node B (second output voltage VD2P) will be equal to VDD minus the P-channel threshold voltage drop (Vtp) across diode-connected device 42. When VDD is not present, second output voltage VD2P will track VDD2, remaining one P-channel voltage drop below VDD2. Therefore, in any circumstance where a relatively high voltage (5 volt) appears at the PAD terminal, VDD2 will be approximately two N-channel diode voltage drops below PAD and VD2P will be another P-channel voltage drop below the VDD2 value. Again, during a "hot plug" condition no voltage greater than the nominal 3.3 will be generated and any circuitry coupled to voltage generator 40 will be protected from high voltages present on the signal line (PAD).

Figure 4:
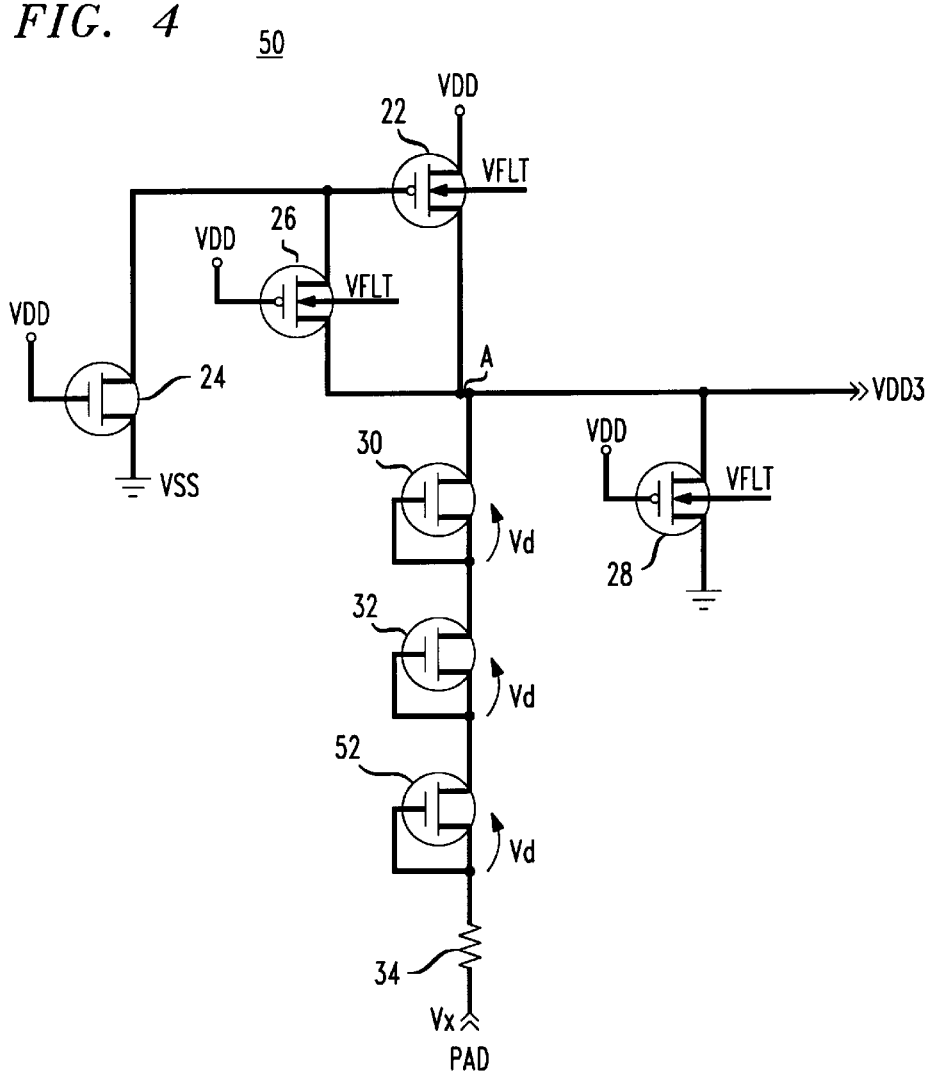
FIG. 4 contains yet another embodiment of a CMOS reference voltage generator circuit formed in accordance with the present invention.

As mentioned above, the voltage generator circuit of the present invention may be configured to include any desired number of voltage drops between the PAD terminal and the VDD2 output terminal (node A). FIG. 4 illustrates an alternative embodiment of the generator circuit of FIG. 2, including a third diode-connected N-channel device 52 in series with diode-connected devices 30 and 32. In this configuration, therefore, output reference voltage VDD3 will remain at least three diode drops below the voltage appearing at the PAD terminal. In some situations where an even lower reference voltage is utilized (or a higher than usual bus voltage may be present), the addition of the third diode-connected device provides additional protection. Since none of these devices are "on" when VDD is present, VDD3 is equal to VDD for that state.

Figure 5:
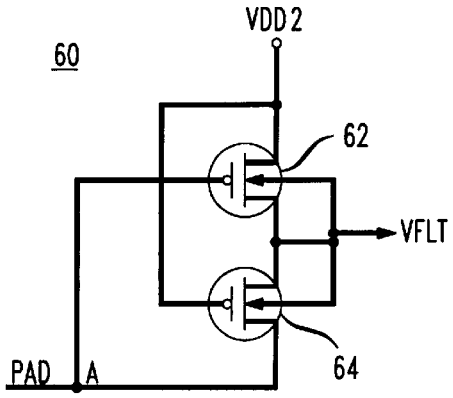
FIG. 5 illustrates a hot-pluggable reference voltage generator, using the invention shown in FIGS. 2–4.

The VDD2 voltage generated by any of the above circuits can thus be safely applied to the source of transistor 62 of FIG. 5. This VDD2 reference voltage will generate a supply voltage VFLT that can be applied to the N-tub backgates of all P-channel transistors, ensuring that their parasitic diodes are not turned on even when PAD exceeds VDD. The VDD2 reference voltage ensures that even when VDD is not present and a relatively high voltage is applied to the PAD, the voltage across the gate oxides of all transistors in the circuit does not exceed a safe limit.

It is to be understood that there exist many other modifications of the illustrated generator circuit that fall within the spirit and scope of the present invention. For example, a complementary arrangement may easily be formed, exchanging the utilizes of VSS and VDD and substituting N-channel devices for P-channel, and vice versa.

What is claimed is:

1. An integrated circuit including a CMOS reference voltage generator for providing an output voltage at an output voltage terminal VDD2 as a function of an input power supply voltage (VDD) and an input signal voltage level at an input signal voltage terminal (PAD), the CMOS generator comprising a first P-channel device coupled at its source to input power supply VDD;

a first N-channel device coupled at its source to ground potential (VSS) and having its gate held at the input power supply VDD, the drain of said first N-channel device coupled to the gate input of the first P-channel device;

a second P-channel device having its gate held at the input power supply VDD and coupled at its drain to the gate of the first P-channel device, the source of said second P-channel device coupled to the drain of the first P-channel device, this coupling defining the output voltage terminal VDD2;

a third P-channel device having its gate held at the input power supply VDD and its drain coupled to ground potential, the source of the third P-channel device coupled to the output voltage terminal, wherein the output voltage at VDD2 is approximately equal to the supply voltage VDD as long as VDD is present; and at least one diode-connected N-channel device coupled between the output terminal and the input signal voltage terminal PAD, each diode-connected device providing a predetermined voltage drop Vd between the input signal voltage level and the voltage appearing at the output terminal VDD2, wherein the output voltage at VDD2 is approximately equal to the input signal voltage level, minus each predetermined voltage drop, when the input supply voltage VDD is not present.

2. An integrated circuit including a voltage generator as defined in claim 1 wherein the at least one diode-connected N-channel device comprises a pair of N-channel devices.

3. An integrated circuit including a voltage generator as defined in claim 1 wherein the at least one diode-connected N-channel device comprises a set of three N-channel devices.

4. An integrated circuit including a voltage generator as defined in claim 1 wherein the voltage generator further comprises a resistance means coupled between the at least one diode-connected N-channel device and the input signal terminal.

5. An integrated circuit including a voltage generator as defined in claim 1 wherein the voltage generator is capable of producing a second output voltage VD2P that is approximately one P-channel threshold voltage less than the output voltage at VDD2, the generator further comprising a fourth P-channel device diode-connected between the output terminal and source of the third P-channel device, wherein the P-channel threshold voltage is the threshold voltage of the fourth P-channel device;

a second N-channel device connected at its drain to the diode connection of the fourth P-channel device and having its source coupled to the drain of the third P-channel device, wherein a biasing current is applied as an input to the gate of the second N-channel device; and a diode coupled across the source and drain of the third P-channel device.

6. An integrated circuit including a backgate reference voltage generator comprising a first P-channel device coupled at its gate to an input signal voltage level at an input signal voltage terminal (PAD);

a second P-channel device coupled at its drain to the input signal voltage level, the source of the second P-channel device coupled to the drain of the first P-channel device, wherein the gate of the second P-channel device and the source of the first P-channel device are coupled to an output voltage at an output voltage terminal VDD2, where the output voltage is generated within a VDD2 generator comprising a third P-channel device coupled at its source to input power supply VDD;

a first N-channel device coupled at its source to ground potential (VSS) and having its gate held at the input power supply VDD, the drain of said first N-channel device coupled to the gate input of the third P-channel device;

a fourth P-channel device having its gate held at the input power supply VDD and coupled at its drain to the gate of the third P-channel device, the source of said fourth P-channel device coupled to the drain of the third P-channel device, this coupling defining the output voltage terminal VDD2;

a fifth P-channel device having its gate held at the input power supply VDD and its drain coupled to ground potential, the source of the fifth P-channel device coupled to the output voltage terminal, wherein the output voltage at VDD2 is approximately equal to the supply voltage VDD as long as VDD is present; and at least one diode-connected N-channel device coupled between the output terminal and the input signal voltage terminal PAD, each diode-connected device providing a predetermined voltage drop Vd between the input signal voltage level and the voltage appearing at the output terminal VDD2, wherein the output voltage at VDD2 is approximately equal to the input signal voltage level, minus each predetermined voltage drop, when the input supply voltage VDD is not present, wherein the drain of the first P-channel device provides an output voltage VFLT for application to N-tub backgates of P-channel transistors.

* * * * *